US012410798B2

(12) United States Patent
Watabe et al.

(10) Patent No.: US 12,410,798 B2
(45) Date of Patent: Sep. 9, 2025

(54) COMPRESSOR

(71) Applicant: Hitachi Industrial Equipment Systems Co., Ltd., Tokyo (JP)

(72) Inventors: Yusuke Watabe, Tokyo (JP); Hiroaki Saito, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 34 days.

(21) Appl. No.: 18/273,406

(22) PCT Filed: Feb. 7, 2022

(86) PCT No.: PCT/JP2022/004709

§ 371 (c)(1),
(2) Date: Jul. 20, 2023

(87) PCT Pub. No.: WO2022/230289

PCT Pub. Date: Nov. 3, 2022

(65) Prior Publication Data

US 2024/0093687 A1 Mar. 21, 2024

(30) Foreign Application Priority Data

Apr. 27, 2021 (JP) ..... 2021-075302

(51) Int. Cl.

| | |
|---|---|
| ***F04C 29/04*** | (2006.01) |
| ***F04B 41/02*** | (2006.01) |
| ***F04C 18/02*** | (2006.01) |

(52) U.S. Cl.

CPC ..... *F04C 29/047* (2013.01); *F04B 41/02* (2013.01); *F04C 18/0215* (2013.01)

(58) Field of Classification Search

CPC ..... F04B 41/02; F04C 9/047; F04C 18/0215

See application file for complete search history.

(56) References Cited

U.S. PATENT DOCUMENTS

2016/0097389 A1* 4/2016 Yamazaki ..... F04C 29/04 417/410.5

FOREIGN PATENT DOCUMENTS

JP 58-161183 U 10/1983
JP S58161183 U * 10/1983

(Continued)

OTHER PUBLICATIONS

Translation of JPS58161183-U (Year: 1983).*

(Continued)

*Primary Examiner* — Connor J Tremarche
(74) *Attorney, Agent, or Firm* — Volpe Koenig

(57) ABSTRACT

A compressor includes: a housing; a compressor body to compress gas; a motor to drive the compressor body; a control board to control the motor; and a tank to store the gas outputted from the compressor body, wherein the housing has: a machine chamber storing the compressor body and the motor; a B-chamber having piping to connect the compressor body with the tank; an A-chamber storing the tank; an A-partition separating the machine chamber from the A-chamber and B-chamber; and a B-partition between the A-chamber and the B-chamber, the A-chamber has an air intake port to introduce ambient air, the A-partition has an A-vent as a hole to communicate between the machine chamber and the A-chamber, and a suction port of the compressor body is located in vicinity to the A-vent.

10 Claims, 15 Drawing Sheets

(56) References Cited

FOREIGN PATENT DOCUMENTS

| | | | | |
|---|---|---|---|---|
| JP | 2003-240266 | A | | 8/2003 |
| JP | 2004-324615 | A | | 11/2004 |
| JP | 2007270665 | A | * | 10/2007 |
| JP | 2013-144928 | A | | 7/2013 |
| JP | 2016-075159 | A | | 5/2016 |
| KR | 10-2004-0002480 | A | | 1/2004 |

OTHER PUBLICATIONS

English Translation of JP-2007270665-A (Year: 2007).*
Korean Office Action issued on Oct. 28, 2024 for Korean Patent Application No. 10-2023-7026279.
International Search Report, PCT/JP2022/004709, Mar. 15, 2022, 4 pgs. (JP/EN).

* cited by examiner

COMPRESSOR

TECHNICAL FIELD

The present invention relates to a compressor.

BACKGROUND ART

The background art in the present technical field includes those disclosed in Patent Literature 1 and Patent Literature 2. Patent Literature 1 discloses a compressor including, as a cooling means for an inverter (11) to drive an electric motor (9), a cooling air duct (12) dedicated to the inverter and a dedicated cooling fan (10) in the duct (12), to cool the inverter (11) by the cooling fan (10) and exhaust air after cooling to the outside, so that efficiency of cooling a compressor (8), the electric motor (9), and the like is improved.

Patent Literature 2 is intended to provide a package compressor, including in a package a compressor body (2), a motor (3) to drive the compressor body (2), and an inverter (4) to control rotating the motor (3), wherein the package compressor is cooled such that restrictions on the arrangement of parts are reduced, while the inverter (4) is sufficiently cooled, to have improved productivity. The package compressor includes the compressor body (2) to compress air, the motor (3) to drive the compressor body (2), the inverter (4) to control a rotation speed of the motor (3), and a cooling fan (5) provided in the compressor body (2), wherein the inverter (4) is disposed in a path for taking in cooling air by the cooling fan (5) in the compressor body (2).

PRIOR ART DOCUMENTS

Patent Literatures

Patent Literature 1: Japanese Patent Application Publication No. 2004-324615 (such as FIGS. 1, 2, and 3, and paragraphs 0025 and 0079), and Patent Literature 2: Japanese Patent Application Publication No. 2016-75159 (such as FIGS. 2, 3, and 5, and paragraphs 0010 and 0012).

SUMMARY OF THE INVENTION

Problems to be Solved

However, Patent Literatures 1 and 2 each fail to describe a technique to reduce both noise and temperature of intake air in a package compressor. The present invention has been devised in view of the above-described situation and is intended to provide a compressor to reduce both noise and temperature of intake air.

Solution to Problem

A compressor of the present invention, to solve the above-identified problems, includes: a housing forming a profile; a compressor body to compress gas; a motor to drive the compressor body; a control board to control the motor; and a tank to store the gas outputted from the compressor body, wherein the housing has: a machine chamber storing the compressor body and the motor; a B-chamber having piping to connect the compressor body with the tank; an A-chamber storing the tank; an A-partition separating the machine chamber from the A-chamber and B-chamber; and a B-partition between the A-chamber and the B-chamber, the A-chamber has an air intake port to introduce ambient air, the A-partition has an A-vent as a hole to communicate between the machine chamber and the A-chamber, and a suction port of the compressor body is located in vicinity to the A-vent.

Advantageous Effects of the Invention

The present invention provides a compressor to reduce both noise and temperature of intake air.

DETAILED DESCRIPTION OF THE EMBODIMENTS

Hereinafter, a description is given in detail of a scroll air compressor as an example of a compressor according to the present invention, with reference to the drawings as required.

First Embodiment

Figure 1A:
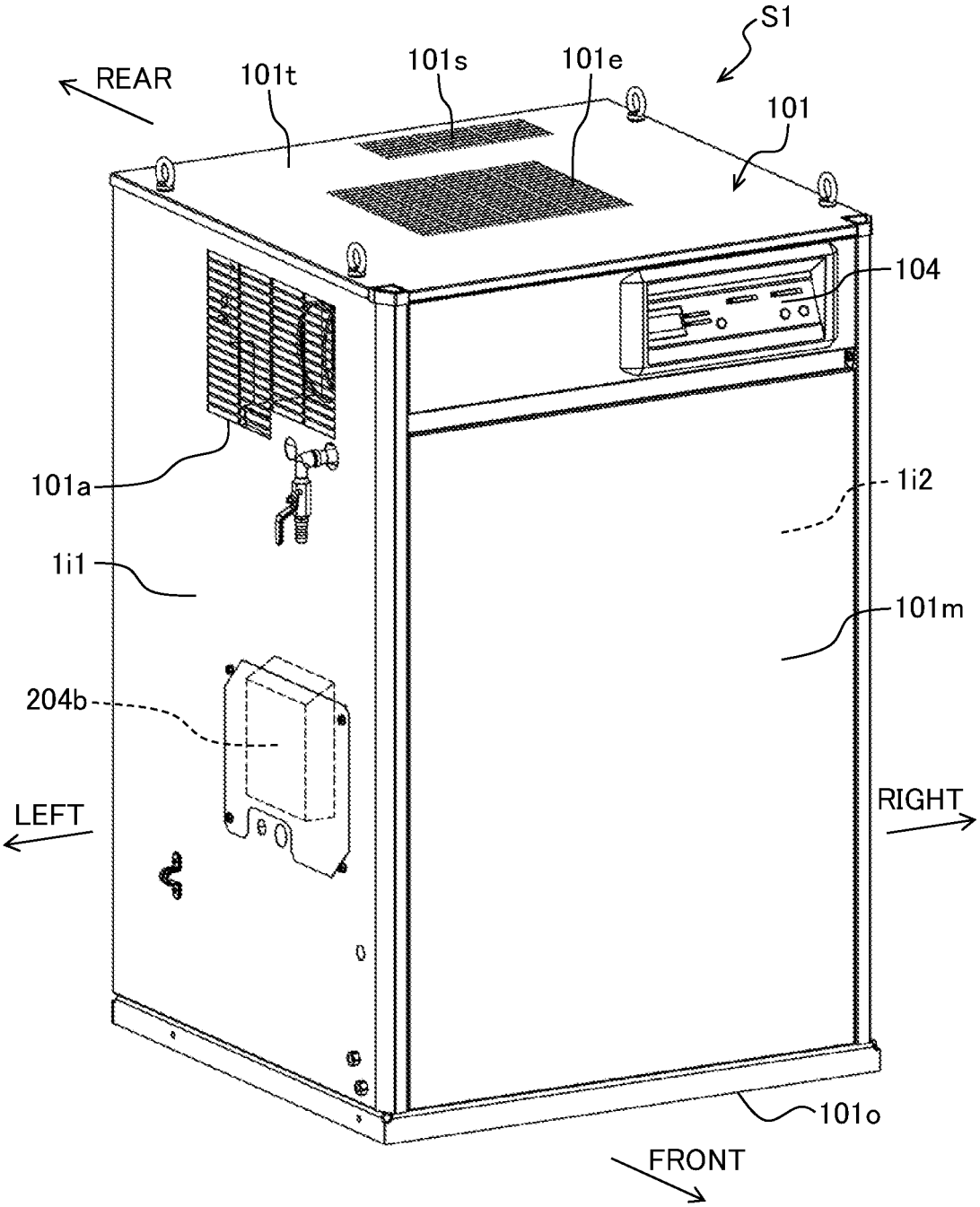
FIG. 1A is a schematic diagram of a scroll compressor according to a first embodiment, as viewed diagonally from above and front.
Figure 1B:
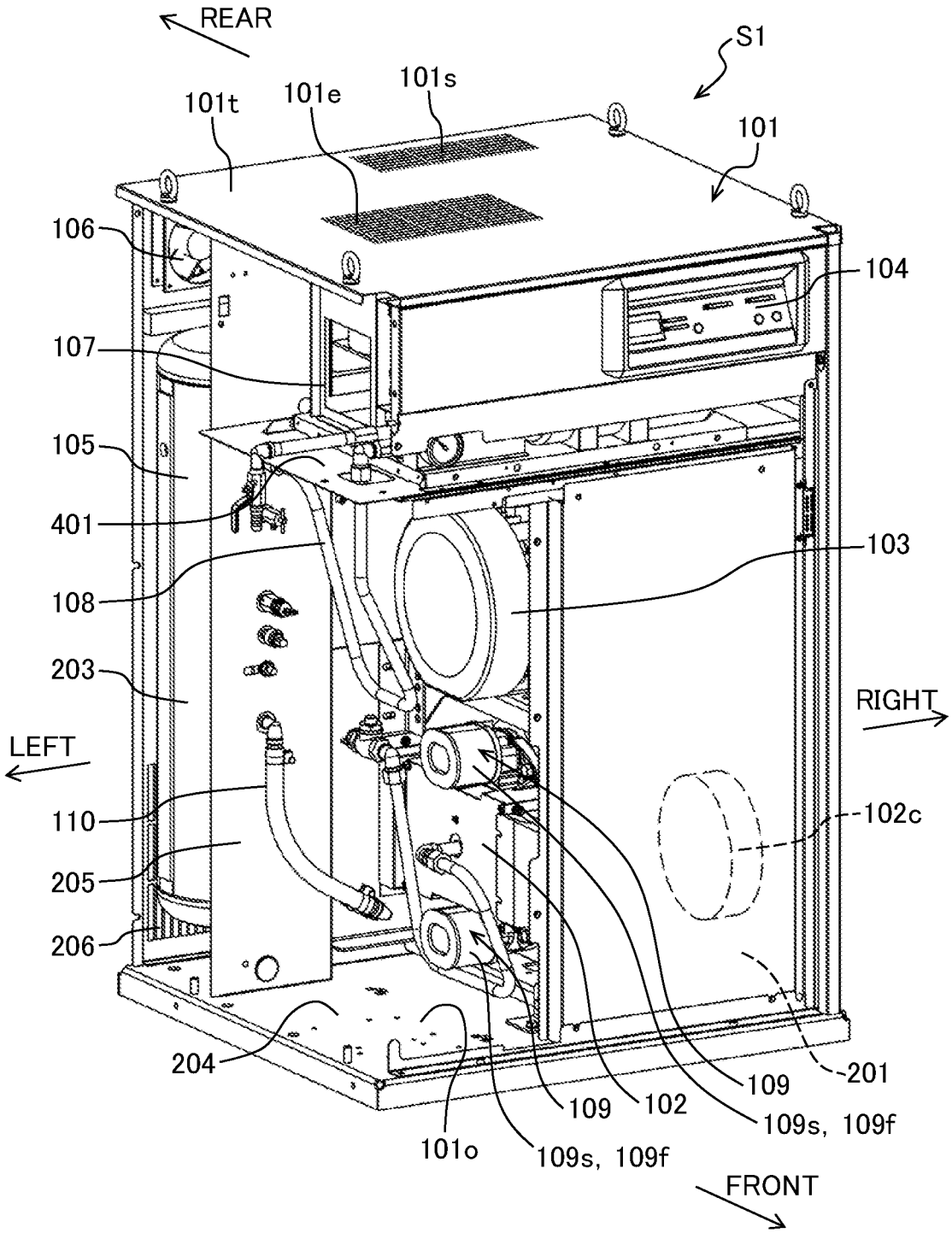
FIG. 1B is a schematic diagram of the scroll compressor according to the first embodiment, with outer plates and a front A-partition of a housing thereof detached.

FIG. 1A is a schematic diagram of a scroll compressor S1 according to a first embodiment, as viewed obliquely from above and front. FIG. 1B is a schematic diagram of the scroll compressor S1 according to the first embodiment 1, with a side plate 1*i*1, a front plate 101*m*, and a front A-partition 202*a* (see FIG. 2A) of a housing 101 detached.

The scroll compressor S1 according to the first embodiment has its contour defined by the housing 101, as shown in FIG. 1A. The housing 101 has a front plate 101*m*, a top plate 101*t*, a rear plate 101*u* (see FIG. 2B), side plates 1*i*1 and 1*i*2, and a bottom plate 1010. An electrical component box 204*b*, containing an electrical component 204*d* (see FIG. 2C) for controlling the scroll compressor S1, is provided inside the side plate 1*i*1. The side plate 1*i*1 is provided with an air intake port 101*a*.

The housing 101 in FIG. 1B is provided therein with a scroll compressor body 102, a motor 103, a control board 104, an air tank 105, an electric fan 106, and an air dryer 107. The scroll compressor body 102 compresses air supplied through a suction port 109. The motor 103 drives the scroll compressor body 102. The control board 104 controls operation of the scroll air compressor S1. The air tank 105 stores compressed air generated by scroll compressor body 102.

The electric fan 106 cools the air tank 105 storing high-temperature compressed air. The air dryer 107 dehumidifies the compressed air stored in the air tank 105. The air dryer 107 is connected to the air tank 105 by a pipe 108 serving as a flow path for the compressed air. The scroll compressor body 102 has the suction port 109 for sucking air. The suction port 109 is provided, on a peripheral surface 109*s* thereof, with a filter 109*f* for removing dust in the air. Note that the present embodiment includes the two suction ports 109 and two filters 109*f*, as an example, but the number of the suction ports 109 and filters 109*f* is not limited to two. For example, the number of the suction ports 109 and filters 109*f* may be one, or three or more.

The scroll compressor body 102 is connected by a rubber hose 110 with the air tank 105 storing compressed air generated by the scroll compressor body 102. The top plate 101*t* of the housing 101 has an exhaust port 101*e* for the air dryer 107 and an exhaust port 101*s* for the scroll compressor body 102 opened therein. The exhaust port 101*e* is used for the air that has cooled the air dryer 107 to be discharged therethrough. The exhaust port 101*s* is used for the air that has cooled the scroll compressor body 102 to be discharged therethrough.

Figure 2A:
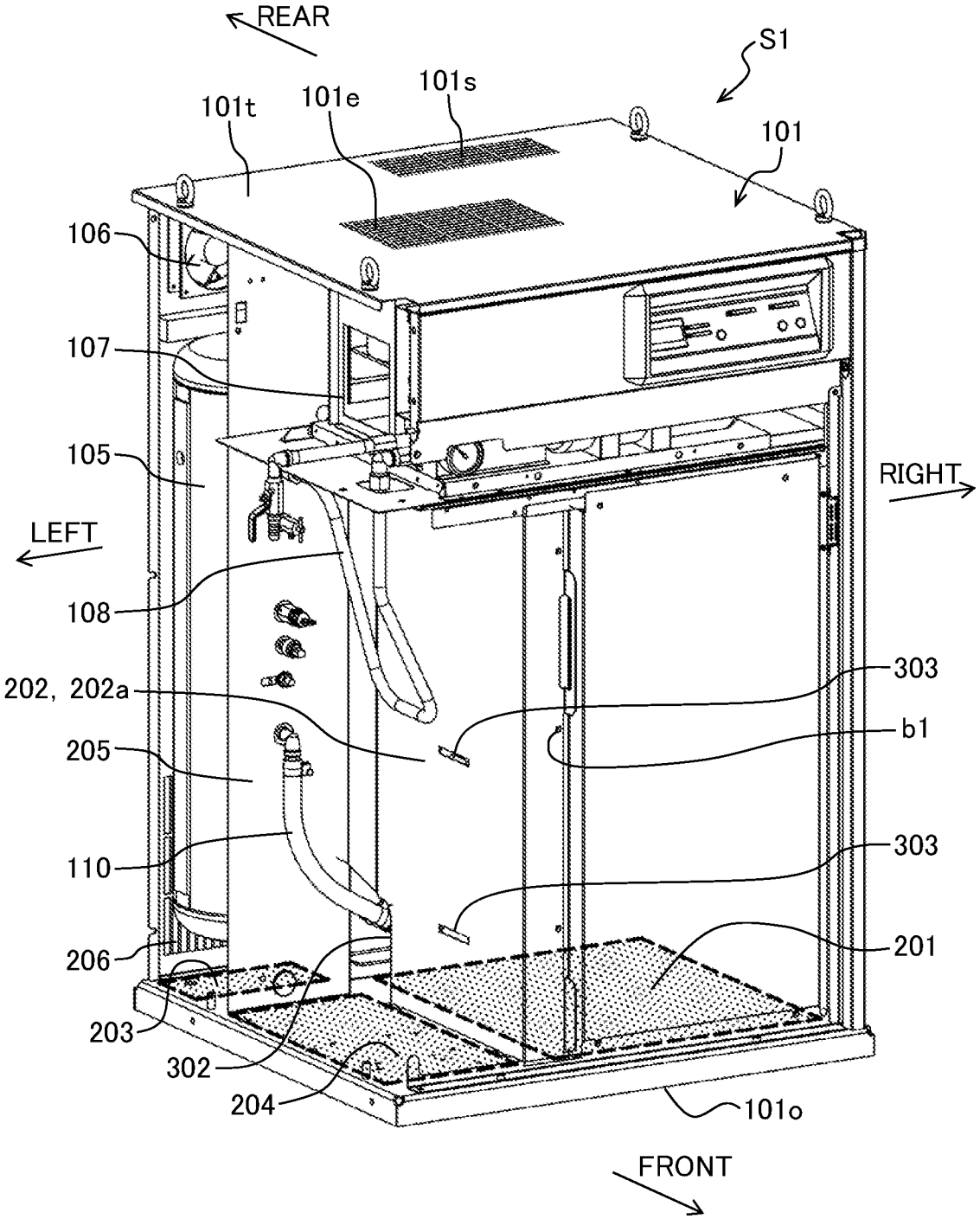
FIG. 2A is a schematic diagram of the scroll compressor according to the first embodiment, with the outer plates of the housing partially detached.
Figure 2B:
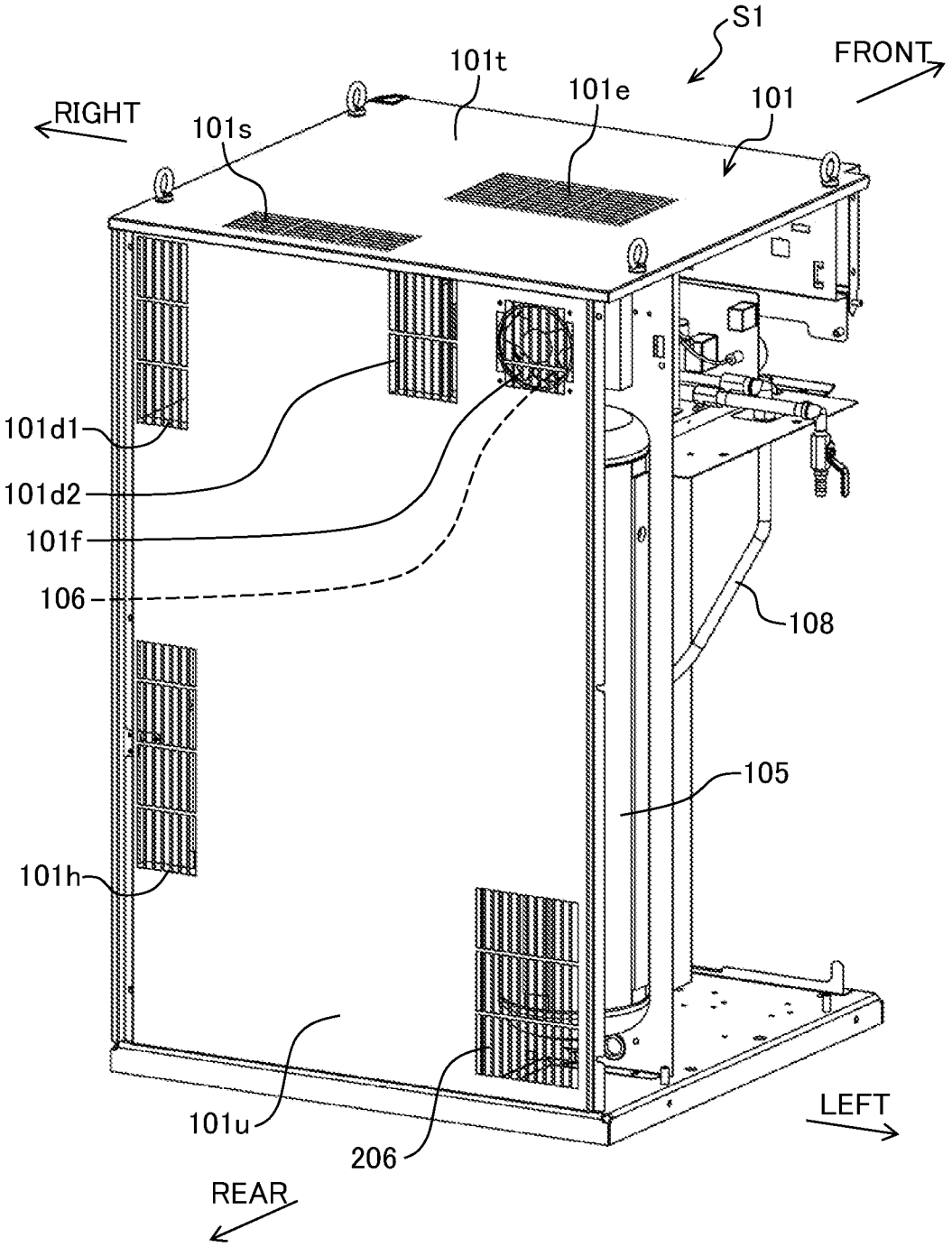
FIG. 2B is a schematic diagram of the scroll compressor, with the outer plates of the housing partially detached, as viewed obliquely from above, left, and rear.

FIG. 2A is a schematic diagram of the scroll compressor S1 according to the first embodiment, with the front plate 101*m* and side plate 1*i*1 of the housing 101 detached. FIG. 2B is a schematic diagram of the scroll compressor S1, with the front plate 101*m* and side plate 1*i*1 of the housing 101 detached, as viewed diagonally from above, left, and rear.

Figure 2C:
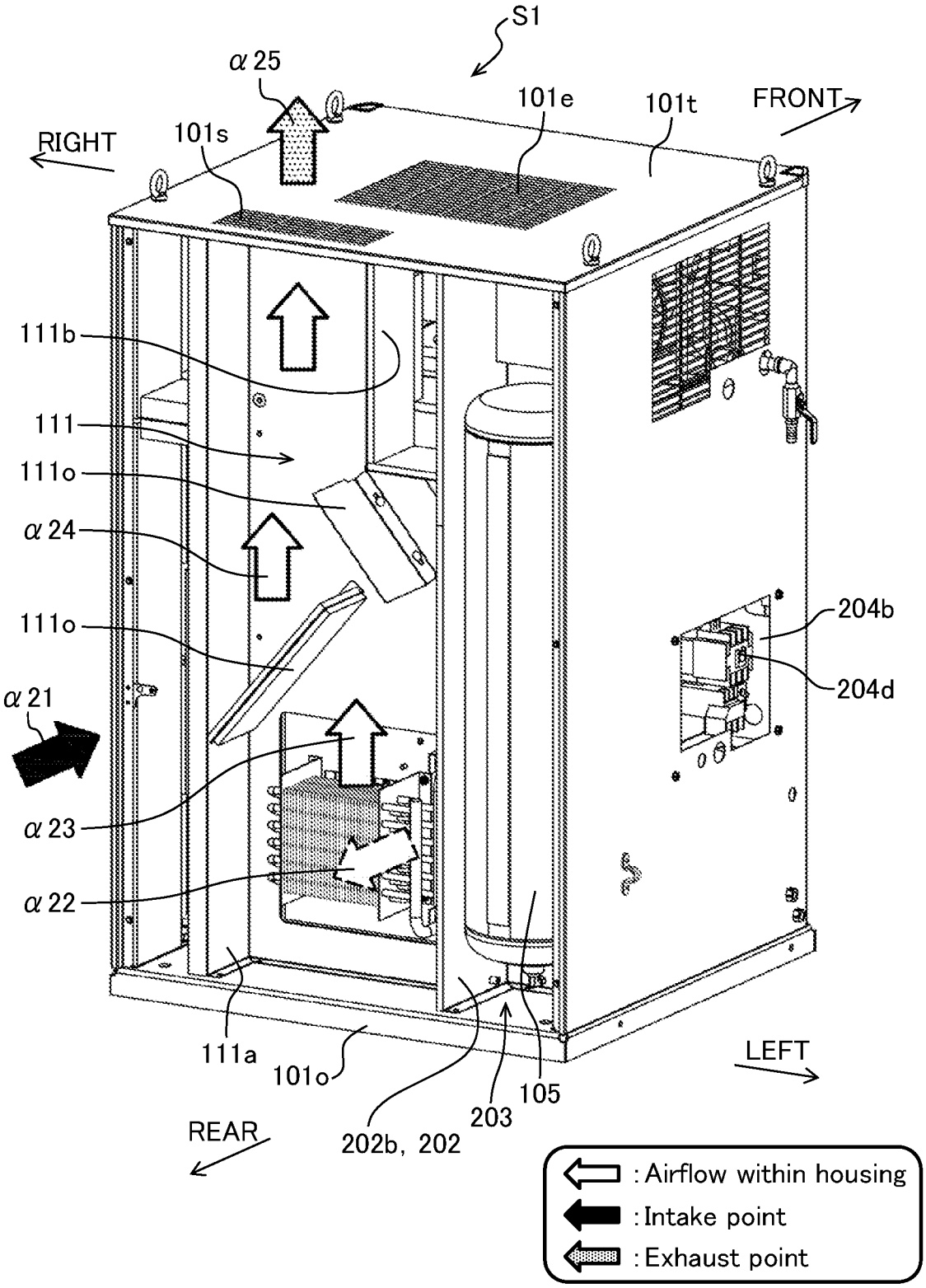
FIG. 2C is a schematic diagram of the scroll compressor, with a rear plate of the housing detached, as viewed obliquely from above, left, and rear.

FIG. 2C is a schematic diagram of the scroll compressor S1, with the rear plate 101*u* of the housing 101 detached, as viewed obliquely from above, left, and rear. Note that a lid of the electrical component box 204*b* is detached in FIG. 2C.

<Machine Chamber 201>

As shown in FIG. 2A, the interior of the housing 101 is partitioned into a machine chamber 201, an A-chamber 203, and a B-chamber 204. The housing 101 is provided therein with a front A-partition 202*a* and a rear A-partition 202*b* (see FIG. 3) to separate the machine chamber 201 from the rest, namely, the A-chamber 203 on a rear side and the B-chamber 204 on a front side. The front A-partition 202*a* and rear A-partition 202*b* constitute an A-partition 202. The rear A-partition 202*b* is fixed to the housing 101. Note that the front A-partition 202*a* and rear A-partition 202*b* may be collectively referred to as the A-partition 202.

Figure 3:
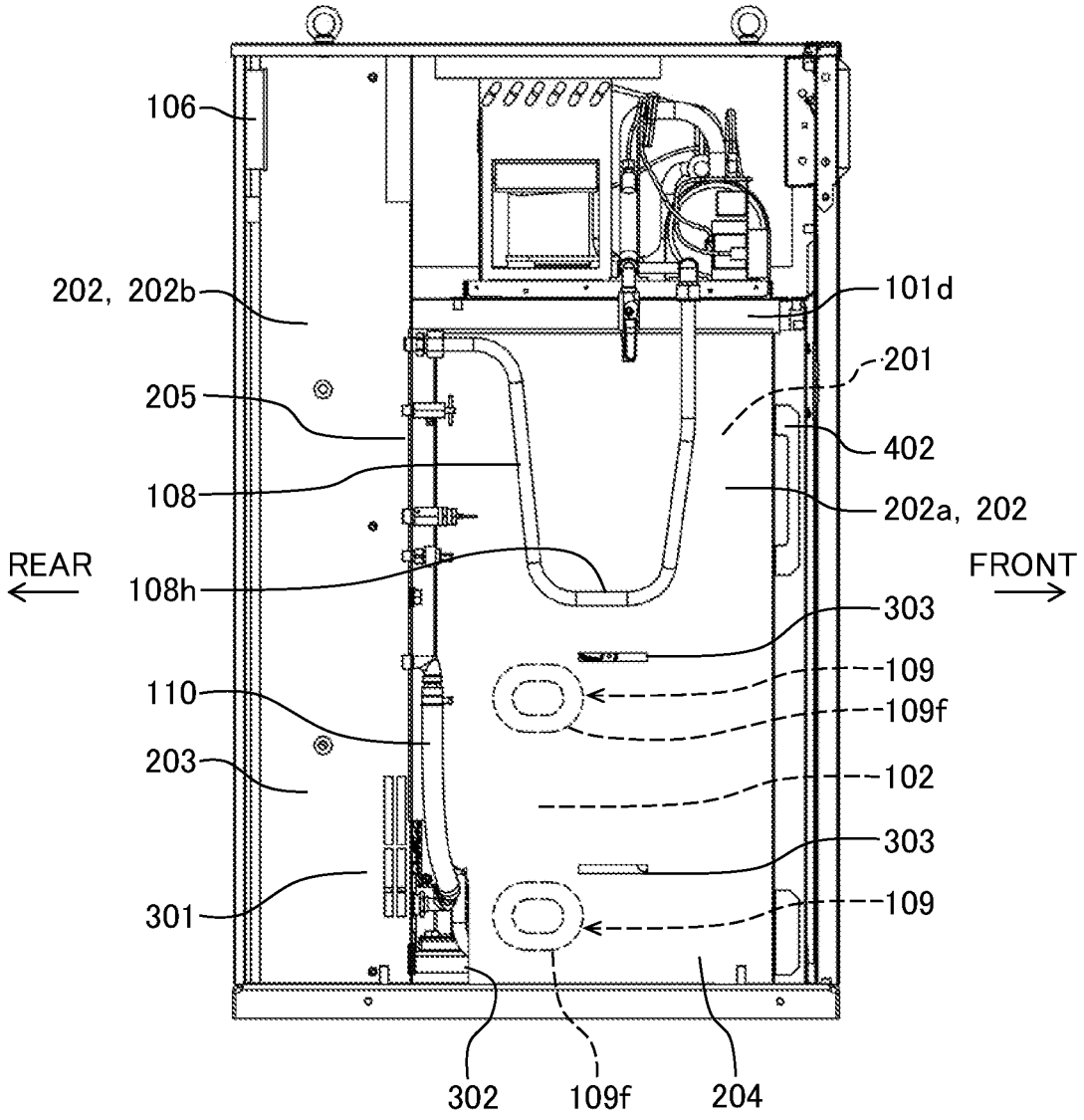
FIG. 3 is a schematic diagram of the scroll compressor according to the first embodiment, with the outer plates and an air tank detached, as viewed from right.

The front A-partition 202*a* as the A-partition 202 is detachable by a user. FIG. 3 is a schematic diagram of the scroll compressor S1 according to the first embodiment, with the outer plates of the housing 101 and the air tank 105 (see FIG. 2A) detached, as viewed from right. The front A-partition 202*a* is provided, at an upper front portion thereof, with a handle 402 to be gripped by the user.

As shown in FIG. 1B, the housing 101 is provided therein with a B-partition 205 to divide a space other than the machine chamber 201 into the A-chamber 203 and the B-chamber 204. The machine chamber 201 houses the scroll compressor body 102 and the motor 103.

<A-Chamber 203>

Figure 4A:
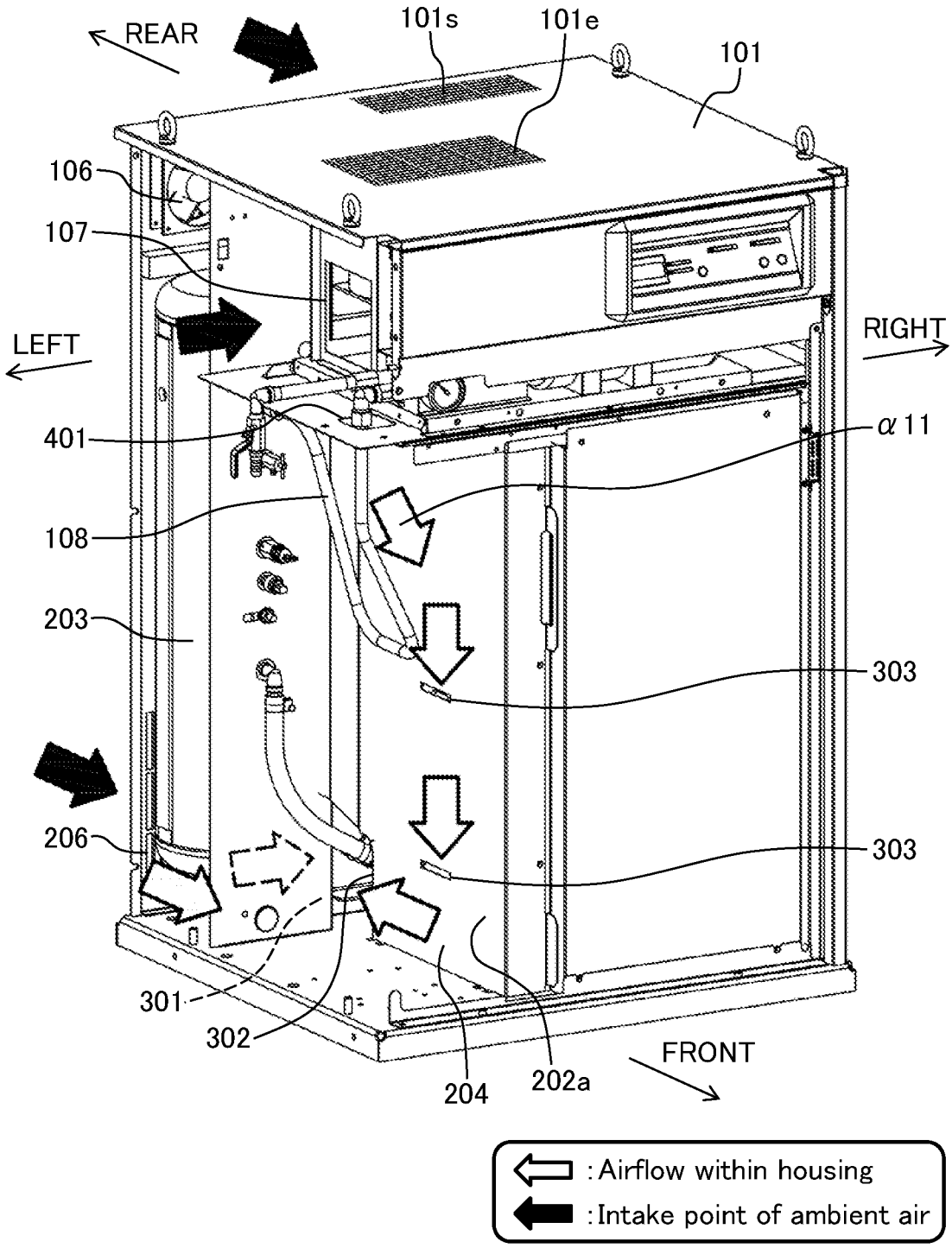
FIG. 4A is a schematic diagram of the scroll compressor according to the first embodiment, with the outer plates of the housing partially detached.

The A-chamber 203 is provided therein with the air tank 105. The A-chamber 203 on the rear side is formed, at a lower rear portion therein, with an air intake port 206 to introduce ambient air. Having the air intake port 206 provided behind a lower portion of the air tank 105 allows the air tank 105 to be cooled with cool air that has flowed through the air intake port 206. As shown in FIG. 4A, the electric fan 106 generates airflow within the A-chamber 203, as a tank chamber, to cause cool air to flow from bottom up. In addition, cool air tends to collect at low points so that having the air intake port 206 at a low point is more effective than the other way around.

As shown in FIG. 2B, the rear plate 101*u* of the housing 101 behind the electric fan 106 is provided, at an upper portion thereof, with an exhaust port 101*f*. In addition, the rear plate 101*u* of the housing 101 is provided with an air intake port 101*h* for the scroll compressor body 102 and air intake ports 101*d*1 and 101*d*2 for the air dryer 107. As a result, the scroll compressor body 102 is cooled by the air entering through the air intake port 101*h* of the rear plate 101*u*. The air dryer 107 is cooled by the air entering through the air intake ports 101*d*1 and 101*d*2 of the rear plate 101*u*.

<B-Chamber 204>

The B-chamber 204 on the front side in FIG. 1B is provided therein with the pipe 108 to connect the air dryer 107 with the air tank 105, and the rubber hose 110 to connect the scroll compressor body 102 with the air tank 105. As shown in FIG. 2C, the B-chamber 204 is provided therein with the electrical component box 204*b* storing the electrical component 204*d*, an electromagnetic valve (not shown) for draining, and the like. In this way, the B-chamber 204, having a comparably large amount of unused space, can accommodate various components such as the pipe 108, the rubber hose 110, the electrical component box 204*b*, and the electromagnetic valve for draining.

As shown in FIG. 3, the front A-partition 202*a* and rear A-partition 202*b* of the A-partition 202 separate the machine chamber 201 from the A-chamber 203 on the rear side and the B-chamber 204 on the front side.

<Exhaust Duct 111>

As shown in FIG. 2C, the rear A-partition 202*b*, a side duct partition 111*a*, an upper duct partition 111*b*, the bottom plate 101*o*, and the top plate 101*t* define an exhaust duct 111. The exhaust duct 111 is provided therein with an airflow guide plate 111*o*. The airflow guide plate 1110 reduces the speed of the air flowed to the exhaust duct 111 to promote heat absorption. A description is given of airflow in the exhaust duct 111.

Cool ambient air is taken into the housing 101 through the air intake port 101*h* of the rear plate 101*u* in FIG. 2B (see a solid thick arrow a21 in FIG. 2C). The air that has entered the housing 101 comes around toward front points in the housing 101, cools the scroll compressor body 102 (see FIG. 1B) installed at a lower front point in the housing 101, and then flows to lower rear points in the housing 101 (see an open broken-line arrow a22 in FIG. 2C). The air that has entered the housing 101 at lower rear points flows upward because a sirocco fan 102*c* for cooling the scroll compressor body 102 blows air (see an open arrow a23 in FIG. 2C). The upward airflow hits the airflow guide plate 1110 to slow down but still flows upward (see an open arrow a24 in FIG. 2C), and is then discharged outside through the exhaust port 101*s* in the top plate 101*t* (gray arrow a25 in FIG. 2C). Additionally, the airflow guide plate 1110 is arranged such that the bottom plate 1010 of the housing 101 cannot be seen through the exhaust port 101*s* when viewed from above, so that a path for the upward airflow a23 is blocked to have effect of reducing noise. In other words, having a path for airflow means to have vibrations also transmitted through the air in the path. Then, avoiding a straight airflow path contributes to reducing noise.

<Vent 301>

As shown in FIG. 3, the rear A-partition 202*b* is provided with at least a vent 301 (A-vent) as a hole to communicate between the machine chamber 201 and the A-chamber 203. The electric fan 106 (see FIG. 4A) generates airflow within the A-chamber 203, as a tank chamber, to cause cool air to flow from bottom up. In addition, cool air tends to collect at low points so that having the vent 301 (A-vent) at a low point is more effective than the other way around. Note that the "low point" includes a point vertically lower than the center and an upstream point in the airflow. The vent 301 is located in vicinity to the suction port 109 (see FIG. 1B) of the scroll compressor body 102 installed in the machine chamber 201. Cool air flows to the scroll compressor body 102 through the vent 301. This causes the scroll compressor body 102 to be effectively cooled, to improve efficiency and performance.

<Vent 302>

The front A-partition 202*a* has a vent 302 (B-vent) to communicate with the B-chamber 204. The air inside the B-chamber 204 enters the machine chamber 201 through the vent 302 and cools the scroll compressor body 102.

As shown in FIG. 2A, the rubber hose 110 runs through the vent 302 to connect the scroll compressor body 102 with the air tank 105. This allows the rubber hose 110 to be cooled by the air flowing through the vent 302.

<Slit 303>

The front A-partition 202*a* has a slit 303 to communicate between the machine chamber 201 and the B-chamber 204. The slit 303 is different from the vent 301 (A-vent) in the rear A-partition 202*b* and the vent 302 (B-vent) in the front A-partition 202*a*, which are shown in FIG. 3. The slit 303 is provided in vicinity to the filter 109*f* over the suction port 109 of the scroll compressor body 102. This allows for effectively supplying cool air through the slit 303 to the filter 109*f* over the suction port 109. That is, the scroll compressor body 109 takes in cool air (air before being warmed by a device such as the motor 103) via the filter 109*f* through the suction port 109, to improve compression efficiency and compression performance.

The slit 303 has a rectangular shape with a short vertical dimension and a long horizontal dimension. The two slits 303 are positioned above the respective suction ports 109 of the scroll compressor body 102. This is for the purpose of letting the air in the B-chamber 204 flow through the slits 303 as a laminar airflow, to interrupt the air warmed by the motor 103 provided above the scroll compressor body 102. Air in the B-chamber 204 is supplied to the suction ports 109 of the scroll compressor body 102 through the slits 303. This allows for supplying cool air in the B-chamber 204 through the slits 303 to the suction ports 109.

As shown in FIG. 3, the two slits 303 are provided below a parallel portion 108*h* of the pipe 108 connecting the air dryer 107 with the air tank 105 so as to be parallel to the parallel portion 108*h*, and above the respective suction ports 109 of the scroll compressor body 102. Note that the upper slit 303 is provided between the lower slit 303 and the motor 103, as viewed laterally. Laminar airflow caused by the shape and arrangement of the slits 303 allows for separating the airflow from the motor 103 and the air from the B-chamber 204. In this way, the slits 303 are provided close to the pipe 108 for the air dryer 107 as well as the motor 103. This allows for cooling the piping 108 and the motor 103.

The noise generated in the machine chamber 201 from the scroll compressor body 102 and the like is transmitted through the front A-partition 202*a* and rear A-partition 202*b*, echoes on inner wall surfaces of the housing 101 in the A-chamber 203 or the B-chamber 204, and then is emitted out of the housing 101. This allows for reducing a noise level of the scroll compressor S1.

Figure 4B:
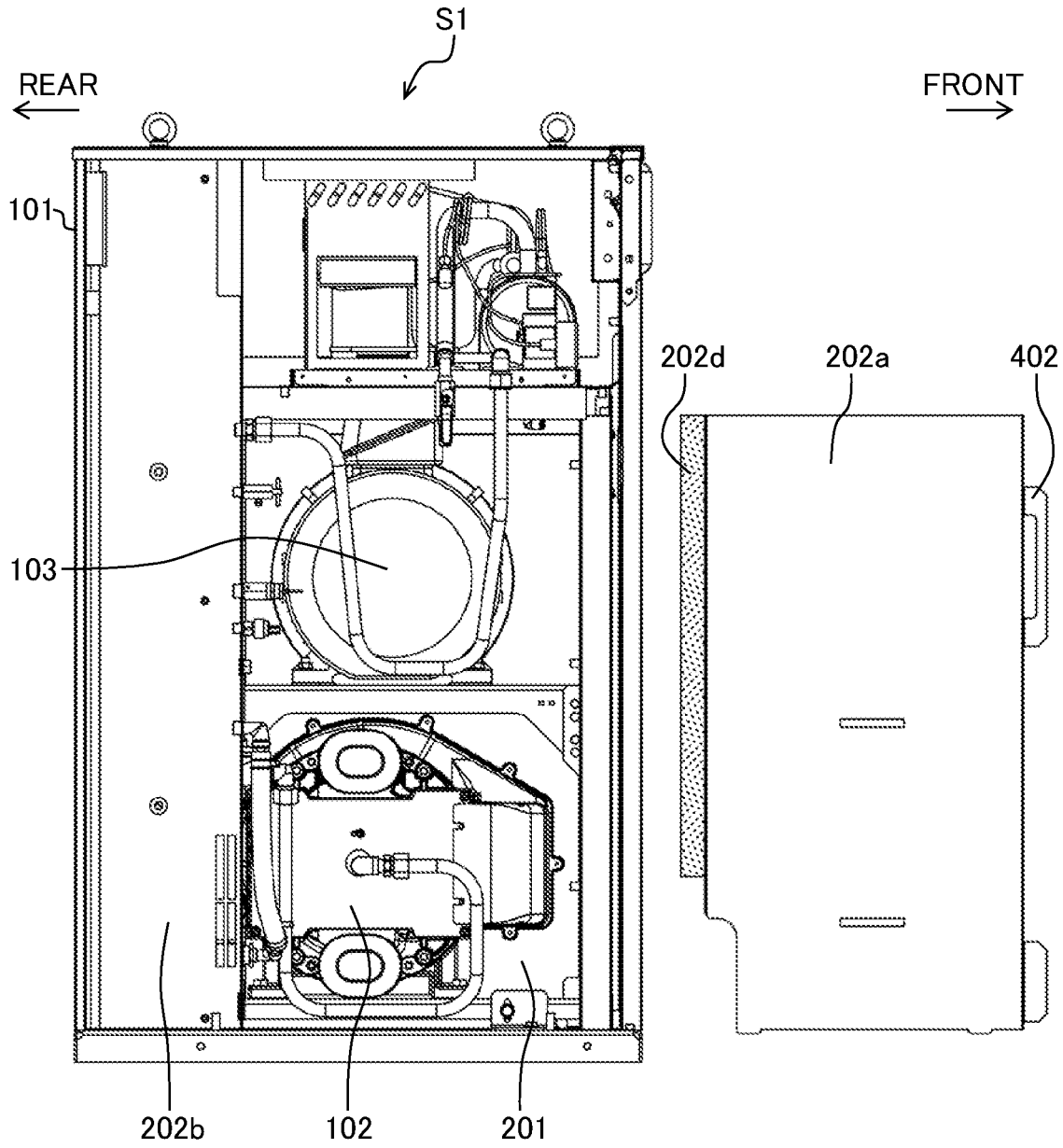
FIG. 4B is a schematic diagram of the scroll compressor according to the first embodiment, with a left side plate of the housing partially detached and a front A-partition detached, as viewed from left.

FIG. 4A is a schematic diagram of the scroll compressor S1 according to the first embodiment, with the side plate 1*i*1 of the housing 101 and a part of the front plate 101*m* detached. FIG. 4B shows a schematic diagram of the scroll compressor S1 according to the first embodiment, with the side plate 1*i*1 of the housing 101 detached and the front A-partition 202*a* detached, as viewed from left. A part of ambient air taken in through the air intake port 206 in the rear plate 101*u* flows through the A-chamber 203 and enters the machine chamber 201 through the vent 301 (A-vent) in the rear A-partition 202*b*, as shown in FIG. 3. The airflow through the A-vent 301 branches and flows toward the motor 103 and to the suction ports 109. In particular, a flow path through the A-vent 301 via the motor 103 to a cooling fan for the motor (electric fan 106) is different from a flow path through the A-vent 301 to the suction port 109. In this way, cool air is supplied through the A-vent 301 to the scroll compressor body 102. That is, the suction ports 109 are arranged so as to be close to the air intake port 206 in terms of a positional relationship with the sirocco fan 103*c*. This allows for sucking cool air (air before being warmed by a device such as the motor 103) flowing through the air intake port 206 via the suction ports 109, to improve compression efficiency.

In addition, the vent 301 in the rear A-partition 202*b* in FIG. 3 is arranged between the electric fan 106, as the cooling fan for the motor 103 (see FIG. 1B), and the suction port 109. These measures reduce suction resistance through the suction port 109, to improve compression performance. That is, the suction port 109 is positioned to suck cool air (air before being warmed by a device such as the motor 103) through the vent 301 in terms of a positional relationship with the electric fan 106, to contribute to improving compression efficiency.

As shown in FIG. 4A, ambient air taken in from around the air dryer 107 located at an upper front point in the housing 101 is supplied through a C-vent 401 to the B-chamber 204 (as indicated by an open arrow all in FIG. 4A). The air supplied through the C-vent 401 (as indicated by the open arrow all in FIG. 4A) flows along the pipe 108 so as to be supplied to the scroll compressor body 102 through the slits 303 and the vent 302. The pipe 108 is cooled by the airflow indicated by the open arrow all in FIG. 4A, so that the temperature of the compressed air to be supplied to the air dryer 107 is reduced to lessen a load for the air dryer 107.

In addition, air is supplied to the suction ports 109 of the scroll compressor body 102 through the slits 303 in the front A-partition 202*a* in FIG. 4A. This prevents warmed air in exchange for cooling the motor 103 inside the machine chamber 201 from being sucked, so that the temperature of the intake air is reduced to improve compression performance. The front A-partition 202*a* of the first embodiment is provided with a handle 402, as shown in FIG. 4B. At a periodic checkout, a user can grip the handle 402 to pull out the front A-partition 202*a*. In this way, having the front A-partition 202 provided with the handle 402 improves handling of the front A-partition 202*a* when pulled out.

As shown in FIG. 2A, the front A-partition 202*a* is fixed at a front portion thereof, which can be easily accessed, by bolts b1, fitting, or the like. For example, the front A-partition 202*a* may be fixed, with the front portion fastened by predetermined number of bolts and a projection at a bottom of the front A-partition 202*a* fitted into a cut in the bottom plate 1010. Note that the front A-partition 202*a* may be fixed without using the bolts b1. When the front A-partition 202*a* is fixed, a top end and a back end thereof are pressed via an elastic body 202*d* (see FIG. 4B) to ensure airtightness, prevent vibration, and improve maintainability. Note that an elastic body 101*d* (see FIG. 3) to face the top end is mounted on the housing 101.

According to the above configuration, the front A-partition 202*a* and rear A-partition 202*b* are provided, as shown in FIG. 3, to separate the machine chamber 201 from the A-chamber 203 on the rear side and the B-chamber 204 on the front side, as shown in FIG. 2A, and the B-partition 205 is provided to divide a space other than the machine chamber 201 into the A-chamber 203 and the B-chamber 204. Then, the air intake port 206, the vent 301, the vent 302, and the like are provided, as shown in FIGS. 2A and 3. This implements a scroll compressor to reduce both noise and temperature of intake air.

Note that the position, quantity, and area of the vent 301 (see FIG. 3), vent 302, and slit 303 may be changed.

Second Embodiment

Figure 5:
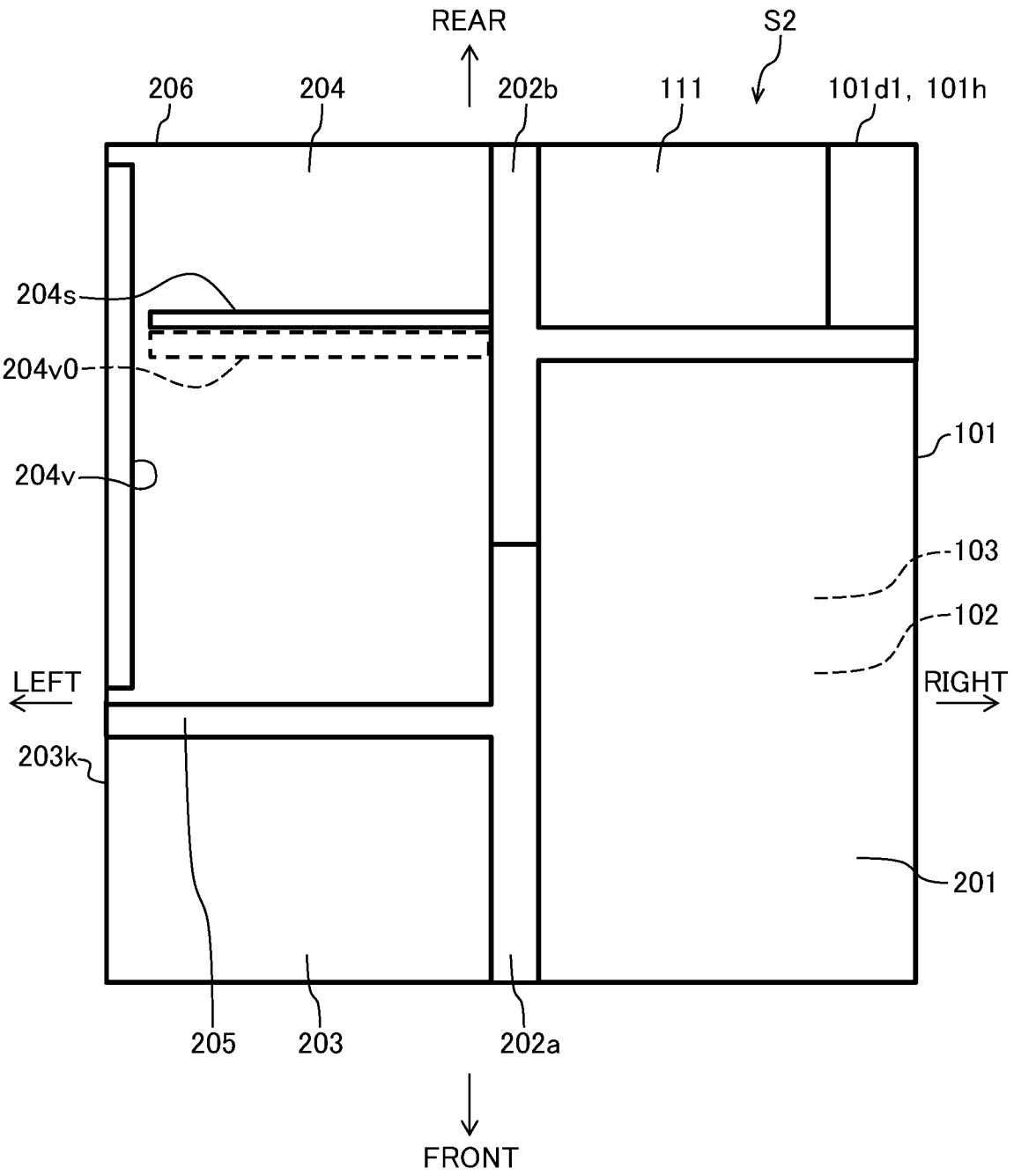
FIG. 5 is a schematic layout of the scroll compressor according to a second embodiment, as viewed from above.

FIG. 5 is a schematic layout of a scroll compressor S2 according to a second embodiment, as viewed from above. The scroll compressor S2 of the second embodiment has the A-chamber 203 provided on the front side and the B-chamber 204 provided on the rear side. Other configurations are the same as those of the first embodiment. This results in the B-chamber 204 having a larger internal volume provided on the rear side, to allow for reducing a dimension of the compressor in depth to have a compressor reduced in size.

Alternatively, the B-chamber 204 having a larger unused internal volume may be provided on the rear side to enlarge the exhaust duct 111 in FIG. 2C. This results in improving cooling performance of the sirocco fan 102*c* (see FIG. 1B) to improve performance of the scroll compressor body 102 and thus performance of the scroll compressor S1.

As shown in FIG. 5, the A-chamber 203 and the B-chamber 204 are laterally next to the machine chamber 201 and the exhaust duct 111. The housing 101 of the scroll compressor S2 is provided, at the bottom in a rear surface thereof defining the B-chamber 204, with the air intake port 206 (also see FIG. 2B). The A-chamber 203 accommodates the air tank 105. A lateral surface of the housing 101 defining the A-chamber 203 is provided, at the bottom therein, with an air intake port 203*k*, as an opening, for cooling the air tank 105 in the A-chamber 203.

The machine chamber 201 accommodates the scroll compressor body 102 on a lower side, and the motor 103 for driving on an upper side. Accordingly, operation noise is generated in the machine chamber 201. Effect of preventing noise may be enhanced with a noise absorbing material attached at a position which is away from the machine chamber 201 and where a large surface is available. Then, a noise absorbing material 204*v* is attached to an inner surface of the housing 101 laterally defining the B-chamber 204. Additionally, a partition 204*s* for noise insulation may be provided in order to further enhance effect of preventing noise. Alternatively, a noise absorbing material 204*v*0 may be attached to the partition 204*s*.

The above-described configuration gives the scroll compressor S2 to enhance effect of preventing noise. Note that only the partition 204*s* for noise insulation may be provided without the noise absorbing material 204*v*, or only the partition 204*s* and noise absorbing material 204*v*0 may be provided. In addition, the scroll compressor S1 as with the first embodiment may have a positional relationship among the machine chamber 201, the A-chamber 203, and the B-chamber 204 changed as in other cases below.

Another Case 1

Figure 6:
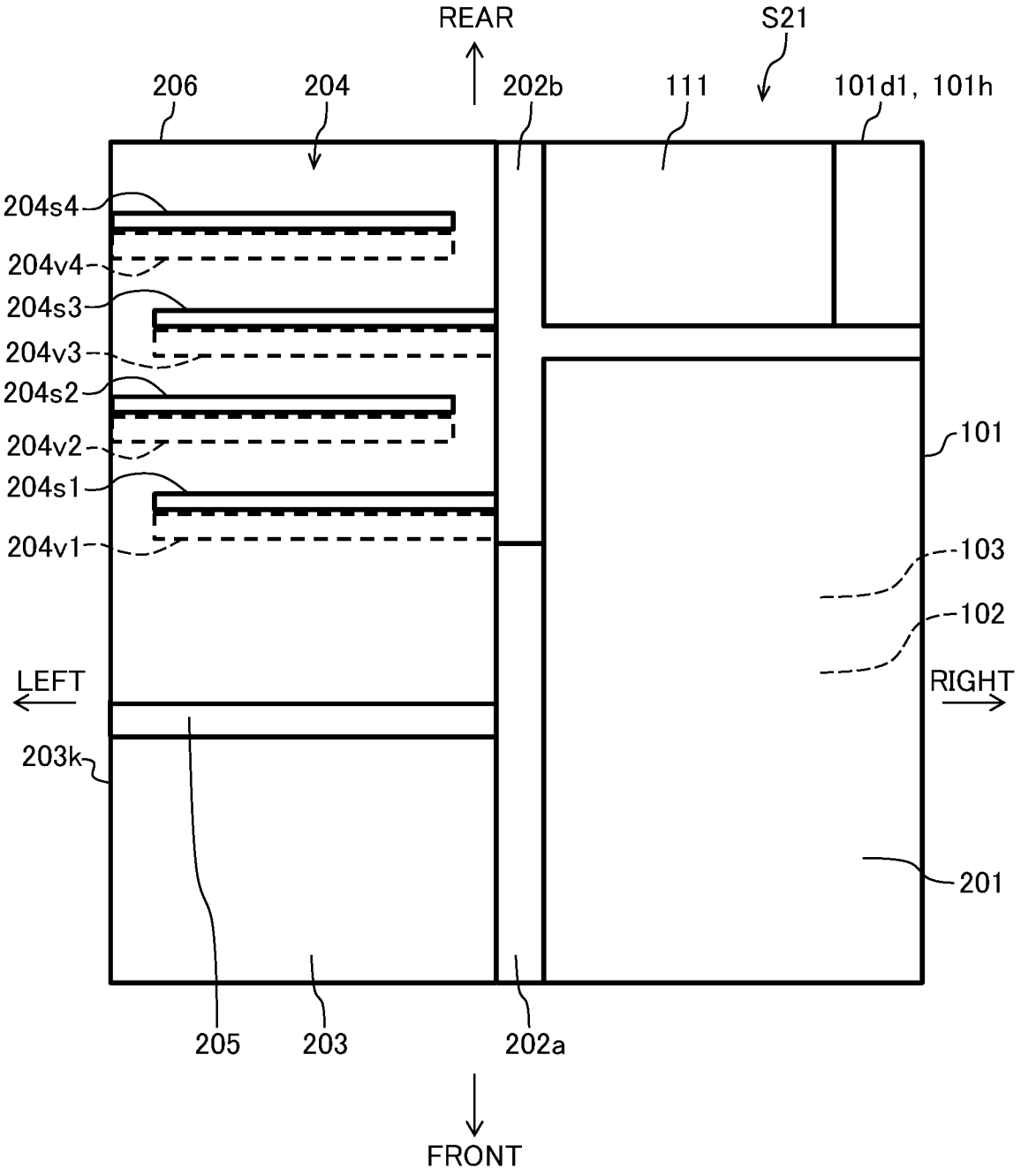
FIG. 6 is a schematic layout of a scroll compressor in another case 1 of the second embodiment, as viewed from above.

FIG. 6 is a schematic layout of a scroll compressor S21 in another case 1 of the second embodiment, as viewed from above. The scroll compressor S21 of another case 1 has the same layout of the machine chamber 201, the A-chamber 203, and the B-chamber 204 as the scroll compressor S2 of the second embodiment. However, partitions 204*s*1, 204*s*2, 204*s*3, and 204*s*4 for noise insulation are arranged such that front ends thereof are alternately aligned. This enhances effect of preventing noise.

Note that the partitions 204*s*1, 204*s*2, 204*s*3, and 204*s*4 for noise insulation may have noise absorbing materials 204*v*1, 204*v*2, 204*v*3, and 204*v*4 respectively attached thereto. This further enhances effect of preventing noise. In addition, the scroll compressor S1 of the first embodiment may have a positional relationship between the scroll compressor body 102 and motor 103 in the machine chamber 201 changed as in another case 2 below.

Another Case 2

Figure 7:
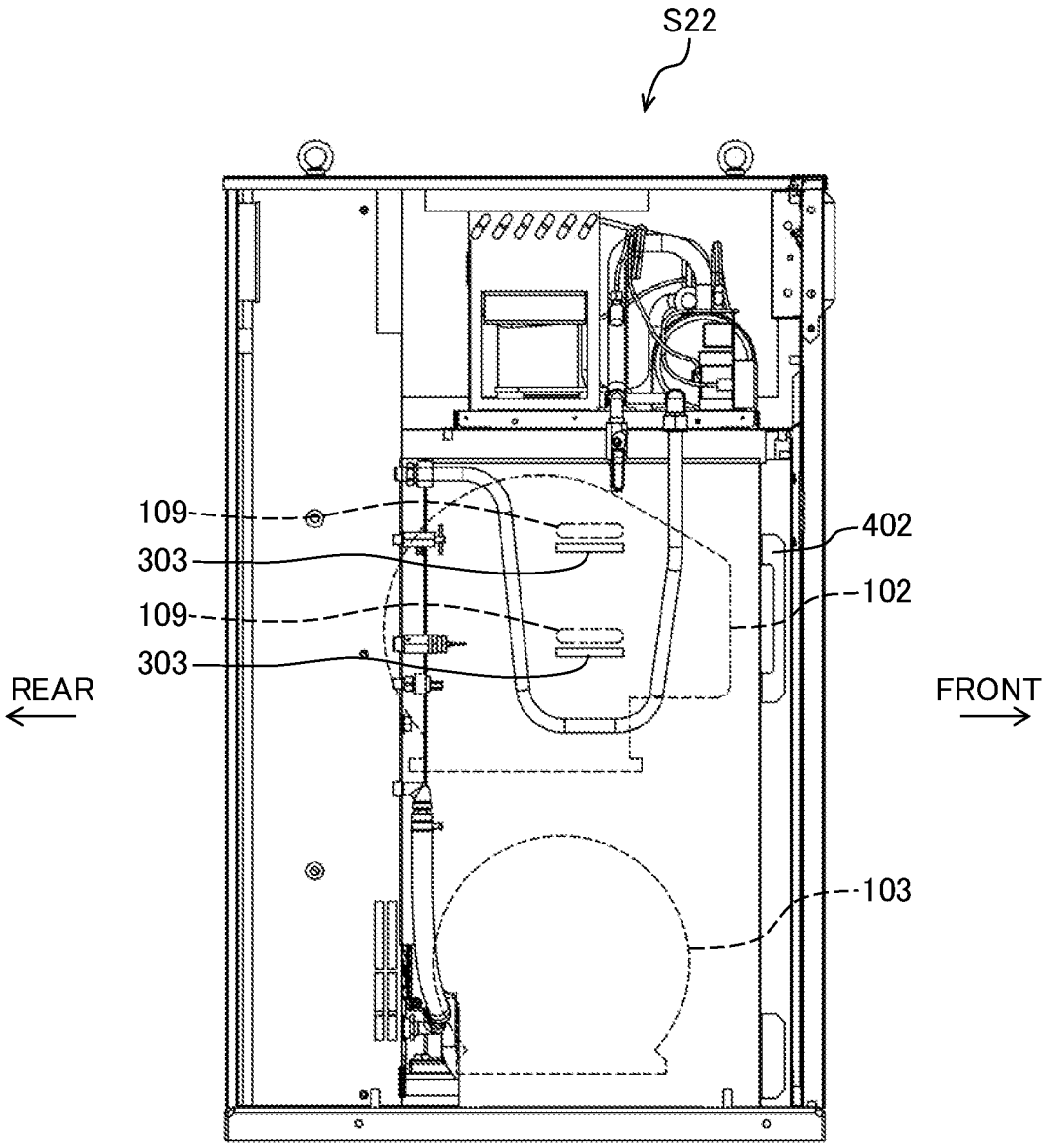
FIG. 7 is a schematic diagram of a scroll compressor in another case 2 of the second embodiment, as viewed from left so as to face an A-chamber and a B-chamber.

FIG. 7 is a schematic diagram of a scroll compressor S22 in another case 2 of the second embodiment, as viewed from left so as to face the A-chamber 203 and B-chamber 204. The scroll compressor S22 of another case 2 has the motor 103 on the lower side in the machine chamber 201, and the scroll compressor body 102 on the upper side. In this case, the scroll compressor body 102 is on the upper side and thus the suction port 109 is also on the upper side. Then, the two slits 303 are provided slightly below the respective suction ports 109 so as to be closer to the motor 103 on the lower side. Laminar airflow to the suction ports 109, through the slits 303 having a short vertical dimension and a long horizontal dimension, generates a so-called air curtain, to prevent the air warmed in exchange for cooling the motor 103 on the lower side from being sucked into the suction port 109.

That is, when the motor 103 is on the lower side and scroll compressor body 102 is on the upper side within the machine chamber 201, having the slits 303 at positions closer to the motor, with respect to the respective suction ports 109, allows for preventing warmed air, after cooling the motor 103, from entering the suction port 109.

FIRST TO FIFTH MODIFICATIONS

Increasing an area of the vent 301 (see FIG. 3) or the slit 303 (see FIG. 2A) of the scroll compressor S1 according to the first embodiment, for example, increases volume of air to be supplied to the suction port 109 (see FIG. 1B) of the scroll compressor body 102, to improve compression performance. The same reference signs are assigned to the same components as those of the first embodiment, and they are not described. Modifications are shown in which the slit 303 for the suction port 109 of the scroll compressor body 102 of the first embodiment is modified. The suction port 109 of the scroll compressor body 102 in FIGS. 8 to 12B, as described below, is provided on a peripheral surface 109*s* thereof with the filter 109*f*.

First Modification

Figure 8:
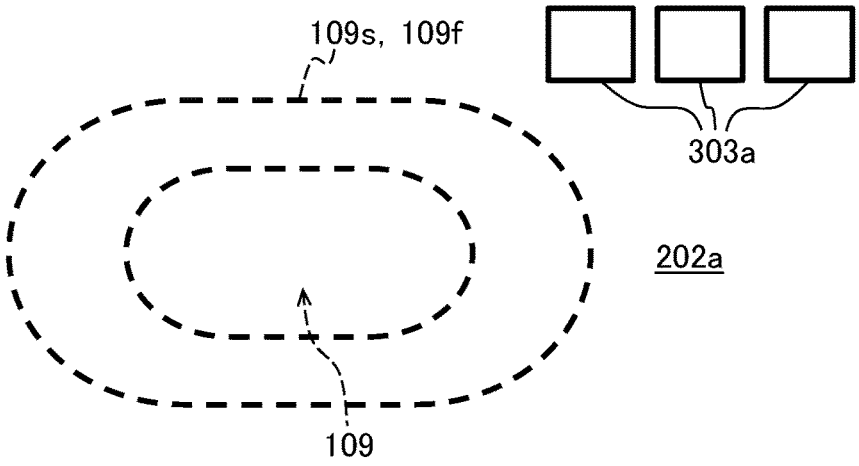
FIG. 8 is a schematic diagram of a slit of a first modification in the front A-partition and a suction port of the scroll compressor body, as viewed from left.

FIG. 8 is a schematic diagram of a slit 303*a* of a first modification in the front A-partition 202*a* and the suction port 109 of the scroll compressor body 102, as viewed from left. The slit 303*a* of the first modification may form a flow path, with two or more holes provided in vicinity to the filter 109*f* on the peripheral surface 109*s* of the suction port 109. The slit 303*a* including the two or more holes are formed to have a short vertical dimension and a long horizontal dimension as a whole.

Second Modification

Figure 9:
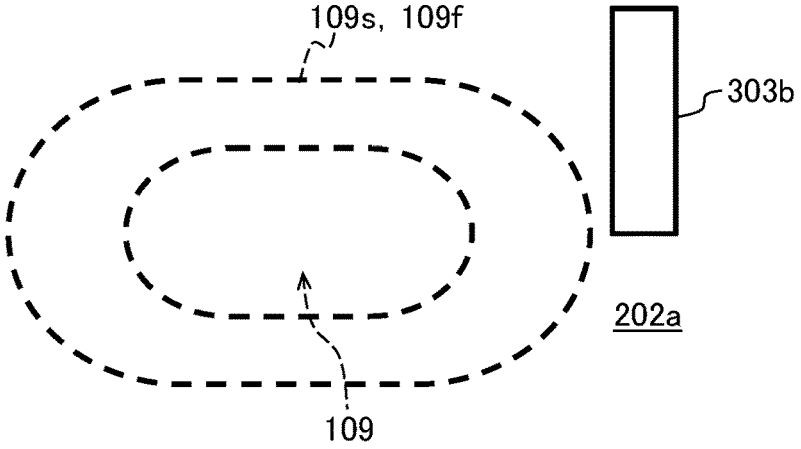
FIG. 9 is a schematic diagram of a slit of a second modification in the front A-partition and the suction port of the scroll compressor body, as viewed from left

FIG. 9 is a schematic diagram of a slit 303*b* of a second modification in the front A-partition 202*a* and the suction port 109 of the scroll compressor body 102, as viewed from left. The slit 303*b* of the second modification is a vertically long hole in vicinity to the filter 109*f* on the peripheral surface 109*s* of the suction port 109. That is, the slit 303*b* is a hole with a short horizontal dimension and a long vertical dimension.

Third Modification

Figure 10:
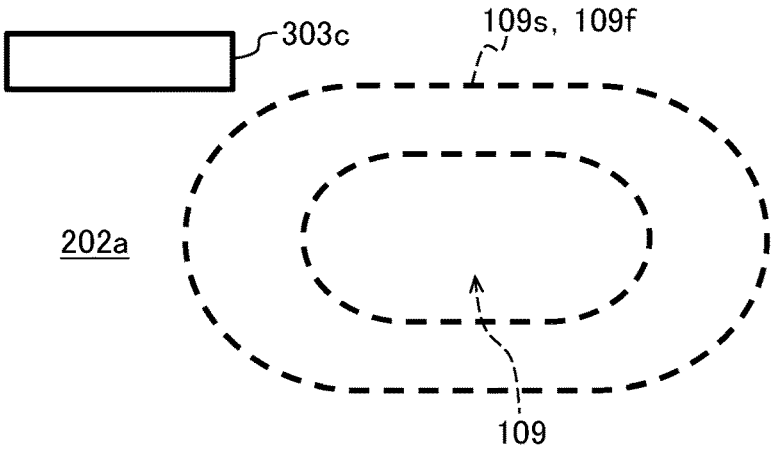
FIG. 10 is a schematic diagram of a slit of a third modification in the front A-partition and the suction port of the scroll compressor body, as viewed from left.

FIG. 10 is a schematic diagram of a slit 303*c* of a third modification in the front A-partition 202*a* and the suction port 109 of the scroll compressor body 102, as viewed from left. The slit 303*c* of the third modification is a horizontally long hole in vicinity to the filter 109*f* on the peripheral surface 109*s* of the suction port 109. That is, the slit 303*c* is a hole with a long horizontal dimension and a short vertical dimension.

Fourth Modification

Figure 11A:
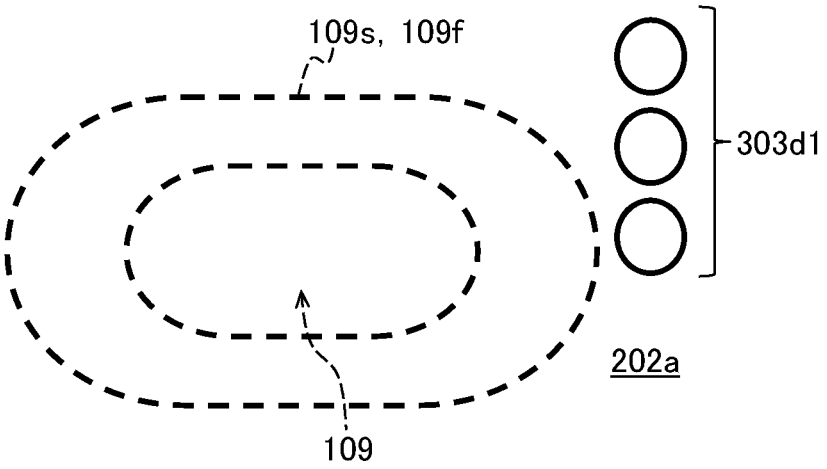
FIG. 11A is a schematic diagram of a slit of a fourth modification in the front A-partition and the suction port of the scroll compressor body, as viewed from left.
Figure 11B:
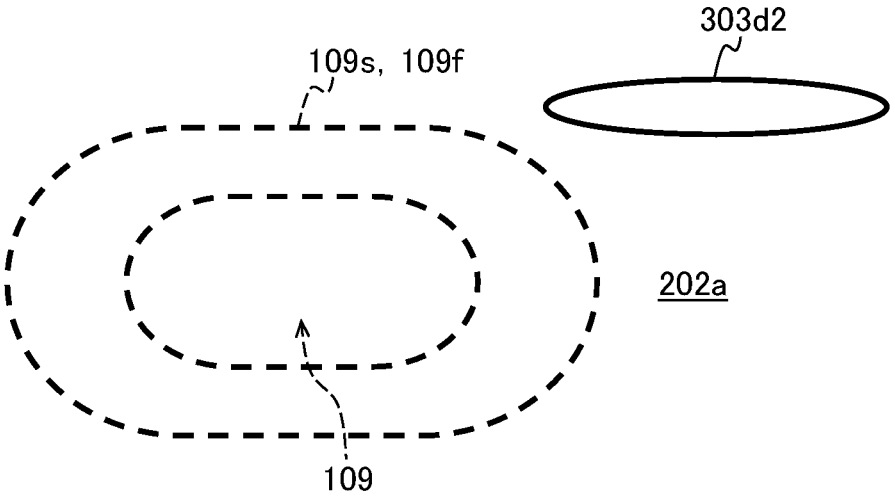
FIG. 11B is a schematic diagram of a slit of the fourth modification in the front A-partition and the suction port of the scroll compressor body, as viewed from left.

FIGS. 11A and 11B are schematic diagrams of slits 303*d*1 and 303*d*2 of a fourth modification, respectively, in the front A-partition 202*a* and the suction port 109 of the scroll compressor body 102, as viewed from left.

The slit 303*d*1 of the fourth modification in FIG. 11A includes three round holes in vicinity to the filter 109*f* on the peripheral surface 109*s* of the suction port 109. The slit 303*d*1 in a round shape is a slit with a long vertical dimension and a short horizontal dimension in all three round holes.

The slit 303*d*2 of the fourth modification in FIG. 11B is a hole, having curvature distribution to form a flat shape, in vicinity to the filter 109*f* on the peripheral surface 109*s* of the suction port 109. As described with the fourth modification, the slit 303 need not be a rectangular hole.

Fifth Modification

Figure 12A:
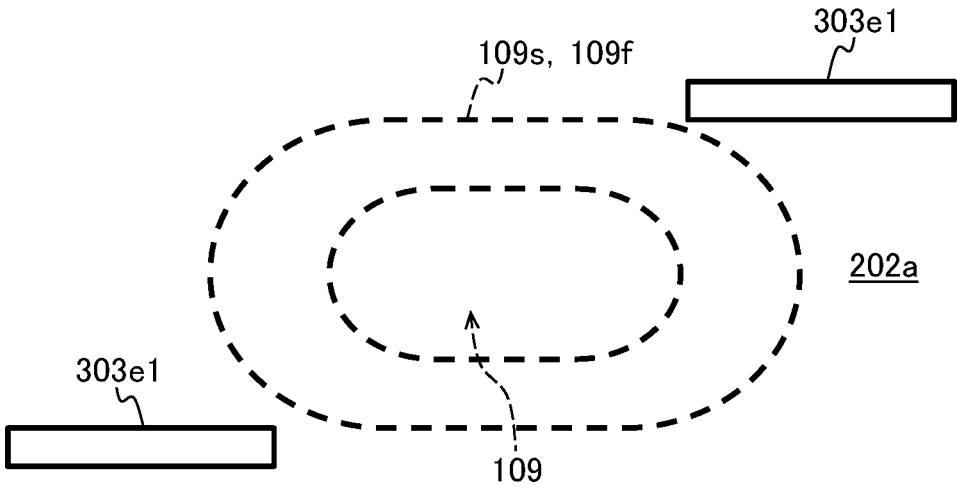
FIG. 12A is a schematic diagram of a slit of a fifth modification in the front A-partition and the suction port of the scroll compressor body, as viewed from left.
Figure 12B:
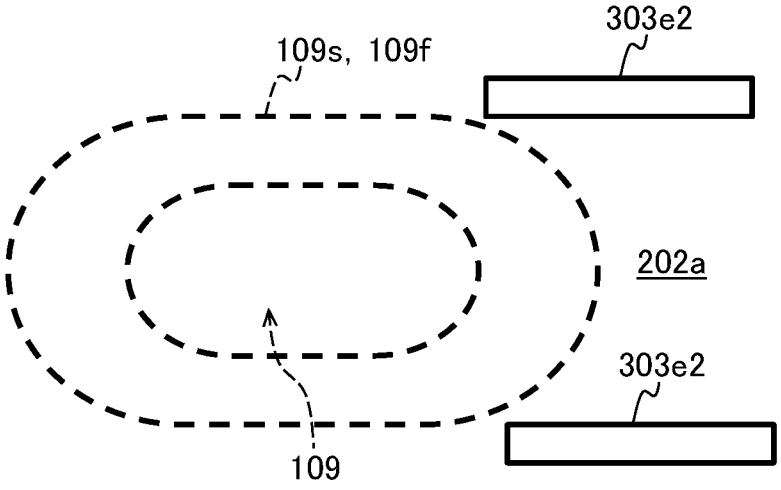
FIG. 12B is a schematic diagram of a slit of the fifth modification in the front A-partition and the suction port of the scroll compressor body, as viewed from left.

FIGS. 12A and 12B are schematic diagrams of slits 303*e*1 and 303*e*2 of a fifth modification, respectively, in the front A-partition 202*a* and the suction port 109 of the scroll compressor body 102, as viewed from left. The fourth modification has a modified positional relationship between the suction port 109 of the scroll compressor body 102 and the slit 303.

The slits 303*e*1 of the fifth modification in FIG. 12A are formed as horizontally long slits at diagonal positions in vicinity tor the filter 109*f* on the peripheral surface 109*s* of the suction port 109. The slits 303*e*2 of the fifth modification in FIG. 12B are formed as two oblong slits at positions on either one of right and left sides, and in vicinity to the filter 109*f* on the peripheral surface 109*s*, of the suction port 109. The first to fifth modifications as described above also allow for sucking unwarmed air through the suction ports 109 of the scroll compressor body 102, while interrupting the air warmed in exchange for cooling the motor 103.

Sixth Modification

Figure 13A:
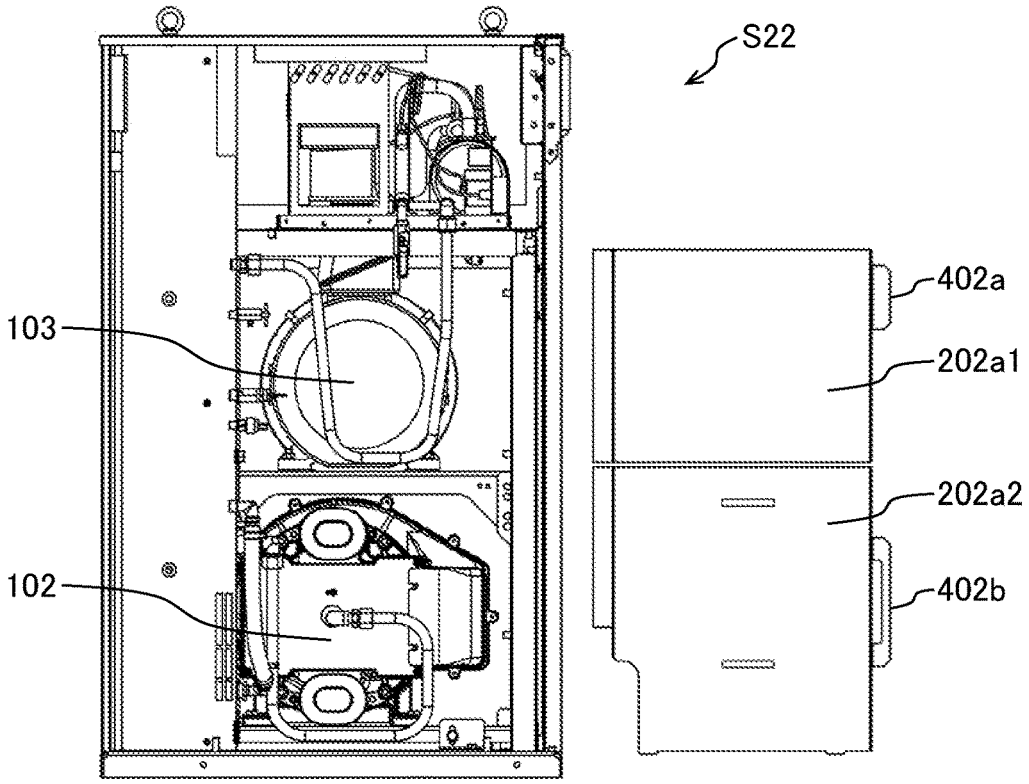
FIG. 13A is a diagram of a scroll compressor according to a sixth modification, with a first front A-partition and a second front A-partition detached, as viewed from left so as to face the A-chamber and B-chamber.
Figure 13B:
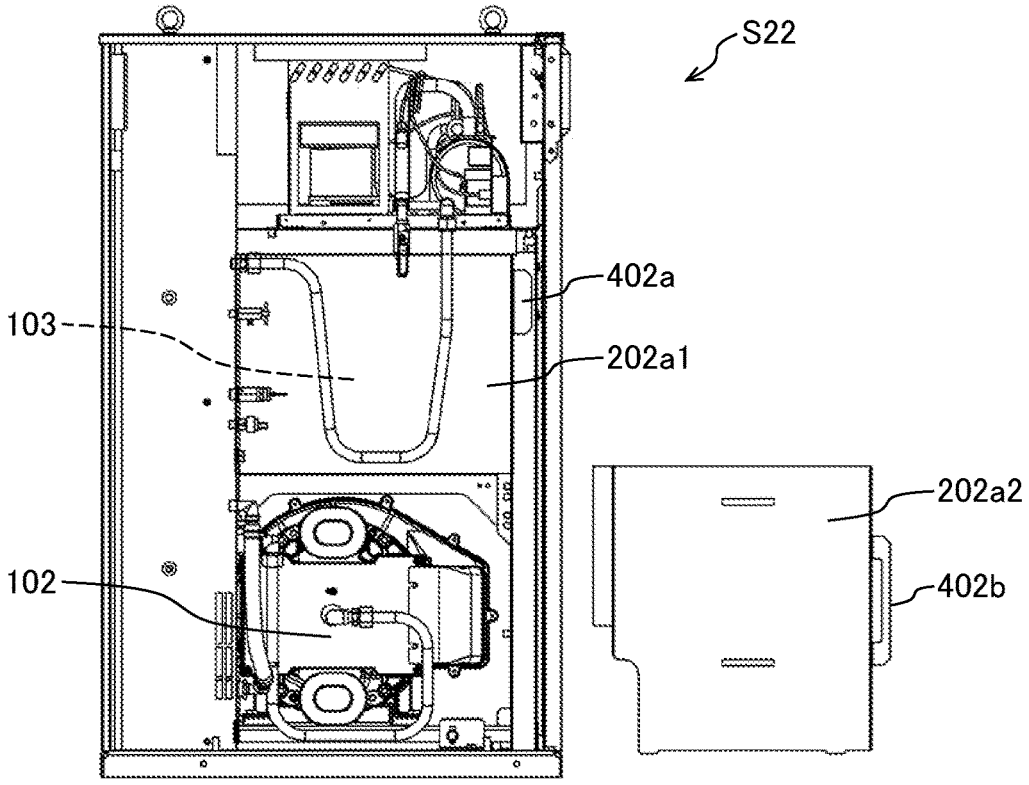
FIG. 13B is a diagram of the scroll compressor according to the sixth modification, with the first front A-partition not detached and the second front A-partition detached, as viewed from left so as to face the A-chamber and B-chamber.

FIG. 13A is a diagram of the scroll compressor S22 according to a sixth modification, with a first front A-partition 202*a*1 and a second front A-partition 202*a*2 detached, as viewed from left so as to face the B-chamber 204 and A-chamber 203. FIG. 13B is a diagram of the scroll compressor S22 according to the sixth modification, with the first front A-partition 202*a*1 not detached and the second front A-partition 202*a*2 detached, as viewed from left so as to face the B-chamber 204 and A-chamber 203.

The sixth modification is configured to have the front A-partition 202*a*, as described in the embodiments, divided into two, the first front A-partition 202*a*1 and the second front A-partition 202*a*2. The front A-partition 202*a* of the sixth modification has the first front A-partition 202*a*1 for separation from an area in the machine chamber 201 to store the motor 103, and the second front A-partition 202*a*2 for separation from an area in the machine chamber 201 to store the scroll compressor body 102. The first front A-partition 202*a*1 and second front A-partition 202*a*2 are attachable and detachable. The first front A-partition 202*a*1 is provided with a handle 402*a* to be gripped. The second front A-partition 202*a*2 is provided with a handle 402*b* to be gripped.

The user can detach and attach the first front A-partition 202*a*1 and second front A-partition 202*a*2 by gripping the handles 402*a* and 402*b*, respectively, as shown in FIG. 13A. In addition, the user can also pull out only the second front A-partition 202*a*2 by gripping the handle 402*b*, without pulling out the first front A-partition 202*a*1, as shown in FIG. 13B. The user can also detach and attach only the first front A-partition 202*a*1 by gripping the handle 402*a*, even though not shown. The sixth modification improves handling of the scroll compressor S22.

Other Embodiments

1) In the embodiments, the A-partition is composed of the front A-partition 202*a* and the rear A-partition 202*b*, with the rear A-partition 202*b* fixed to the housing 101 and the front A-partition 202*a* provided with the handle 402 (see FIG. 3) so as to be detached, but the entire A-partition may be configured to have the handle 402 (see FIG. 3) so as to be detached. This allows the user to grip the handle 402 to detach and attach the entire A-partition, to improve maintainability and handling.

2) Hereinabove, the embodiments and modifications have been described, but the present invention is not limited thereto and includes various modifications. For example, the embodiments and modifications have been described in detail for the purpose of illustrating the present invention, and are not necessarily limited to those having all the described configurations. In addition, the configuration of an embodiment or a modification may partly be replaced with the configuration of another modification, or the configuration of an embodiment or a modification may be added with the configuration of another embodiment or modification. Further, the configuration of each embodiment or modification may partly be removed, or added or replaced with another configuration.

For example, the compressor body can be replaced with that of a compressor other than the scroll compressor, such as a screw compressor and a reciprocating compressor. From another perspective, the entire package may be arranged in a space filled with a specific gas, to compress any gas other than air, such as hydrogen gas, nitrogen gas, or Freon gas.

LIST OF REFERENCE SIGNS

101: housing, 102: scroll compressor body (compressor body), 103: motor, 104: control board, 105: air tank (tank), 106: electric fan (cooling fan), 107: air dryer, 108: pipe, 109: suction port, 109*f*: filter, 110: rubber hose, 201: machine chamber, 202: A-partition, 202*a*: front A-partition (A-partition), 202*b*: rear A-partition (A-partition), 203: A-chamber, 204: B-chamber, 204*d*: electrical component, 205: B-partition, 206: air intake port, 301: A-vent (hole to communicate), 302: B-vent, 303: slit, 401: C-bent, 402: handle, and S1; S2; S21: compressor (scroll compressor).

The invention claimed is:

1. A compressor comprising:

a housing forming a profile;

a compressor body to compress gas;

a motor to drive the compressor body;

a control board to control the motor; and a tank to store the gas outputted from the compressor body, wherein the housing has:

a machine chamber storing the compressor body and the motor, a B-chamber having piping to connect the compressor body with the tank, an A-chamber storing the tank, an A-partition separating the machine chamber from the A-chamber and B-chamber, a B-partition between the A-chamber and the B-chamber, and an exhaust duct used to exhaust air taken into the housing through a first air intake port in a rear plate of the housing and having cooled the compressor body, wherein the A-chamber has a second air intake port to introduce ambient air, the second air intake port is at a position in the rear plate near a bottom plate of the housing, wherein a first flow path is created by moving a portion of the ambient air from the second air intake port, through the A-chamber, past the tank, and out of the housing, wherein the A-partition has an A-vent as a hole to communicate between the machine chamber and the A-chamber, wherein a suction port of the compressor body is located in vicinity to the A-vent, and wherein a portion of the A-partition is included in components defining the exhaust duct.

2. The compressor as claimed in claim 1, further comprising:

a cooling fan provided in the rear plate and the A-chamber at a location near a top plate of the housing, and wherein a second flow path through the A-vent to the cooling fan for the motor is different from a third flow path through the A-vent to the suction port.

3. The compressor as claimed in claim 1, wherein the A-partition has a B-vent to communicate with the B-chamber, and a slit to communicate between the machine chamber and the B-chamber, and the slit is located in vicinity to a suction port of the compressor body.

4. The compressor as claimed in claim 1, wherein a front A-partition, included in the A-partition, has a B-vent to communication with the B-chamber, and a slit to communicate between the machine chamber and the B-chamber, the slit is located in vicinity to the suction port, and the slit is at a point where air flowing along the pipe can be sucked, and which is in vicinity to a filter over the suction port.

5. The compressor as claimed in claim 1, wherein a front A-partition, included in the A-partition, has a B-vent to communicate with the B-chamber, and a slit to communicate between the machine chamber and the B-chamber, the slit is located in vicinity to the suction port, and the slit is in a shape having a vertical dimension different from a horizontal dimension.

6. The compressor as claimed in claim 1, wherein a front A-partition, included in the A-partition, has a B-vent to communicate with the B-chamber, and a slit to communicate between the machine chamber and the B-chamber, the slit is located in vicinity to the suction port, and the slit includes two or more members for the suction port.

7. The compressor as claimed in claim 1, wherein a front A-partition, included in the A-partition, has a B-vent to communicate with the B-chamber, and a slit to communicate between the machine chamber and the B-chamber, the slit is located in vicinity to the suction port, and the slit is between the suction port and the motor, as viewed laterally.

8. The compressor as claimed in claim 1, wherein the B-chamber is provided therein with a rubber hose to connect the scroll compressor body with the tank, and an electrical component for controlling the compressor.

9. The compressor as claimed in claim 1, wherein the A-partition can partly or wholly be detached and a detachable portion thereof is provided with a handle.

10. The compressor as claimed in claim 2, wherein the first flow path is different from both the second flow path and the third flow path.

* * * * *